US010426991B2

(12) United States Patent
Barnett

(10) Patent No.: US 10,426,991 B2
(45) Date of Patent: Oct. 1, 2019

(54) EXERCISE DEVICE

(71) Applicant: Larry W. Barnett, New Canaan, CT (US)

(72) Inventor: Larry W. Barnett, New Canaan, CT (US)

( * ) Notice: Subject to any disclaimer, the term of this patent is extended or adjusted under 35 U.S.C. 154(b) by 0 days.

(21) Appl. No.: 15/211,639

(22) Filed: Jul. 15, 2016

(65) Prior Publication Data

US 2017/0014667 A1 Jan. 19, 2017

Related U.S. Application Data

(60) Provisional application No. 62/192,629, filed on Jul. 15, 2015.

(51) Int. Cl.
*A63B 21/068* (2006.01)
*A63B 21/00* (2006.01)
(Continued)

(52) U.S. Cl.
CPC ..... *A63B 21/068* (2013.01); *A63B 21/0428* (2013.01); *A63B 21/0552* (2013.01); *A63B 21/0622* (2015.10); *A63B 21/0628* (2015.10); *A63B 21/4033* (2015.10); *A63B 21/4035* (2015.10); *A63B 21/4045* (2015.10); *A63B 23/0211* (2013.01); *A63B 23/0216* (2013.01); *A63B 23/0227* (2013.01); *A63B 23/03525* (2013.01); *A63B 23/0405* (2013.01); *A63B 21/008* (2013.01); *A63B 21/00061* (2013.01); *A63B 21/00065* (2013.01);
(Continued)

(58) Field of Classification Search
CPC . A63B 22/0087; A63B 22/0089; A63B 23/02; A63B 23/0205; A63B 23/0211; A63B 23/0216; A63B 23/0222; A63B 23/0227; A63B 21/068; A63B 21/0622; A63B 21/0428; A63B 23/03525; A63B 21/0552; A63B 21/4033; A63B 23/0405; A63B 21/4045; A63B 21/4035; A63B 21/05; A63B 2225/09; A63B 21/00061; A63B 2208/0228; A63B 2208/0219; A63B 21/4049; A63B 2225/093; A63B 21/023; A63B 21/015; A63B 21/008; A63B 21/154; A63B 2210/50; A63B 21/0006; A63B 21/0628; A63B 21/4029; A63B 21/4031; A63B 21/4043; A63B 23/03541; A63B 23/1209; A63B 22/0002; A63B 23/12; A63B 23/0355; A63B 22/0023; A63B 22/0605; A63B 2210/58; A63B 2208/0252; Y10S 482/908
See application file for complete search history.

(56) References Cited

U.S. PATENT DOCUMENTS 1,984,165 A * 12/1934 Tolchin ..... A63B 22/203 417/200
2,129,262 A * 9/1938 Cole ..... A63B 22/205 482/132
(Continued)

*Primary Examiner* — Andrew S Lo
(74) *Attorney, Agent, or Firm* — Dilworth IP, LLC

(57) ABSTRACT

An exercise device for performing multiple exercise movements. The device includes a track, a track carriage, and a variable resistance system so that users can exercise multiple muscle groups. The resistance system provides assistance to the user during certain exercise movements and increased difficulty during other exercise movements.

20 Claims, 14 Drawing Sheets

(51) Int. Cl.

| | |
|---|---|
| ***A63B 21/055*** | (2006.01) |
| ***A63B 23/02*** | (2006.01) |
| ***A63B 23/035*** | (2006.01) |
| ***A63B 23/04*** | (2006.01) |
| ***A63B 21/04*** | (2006.01) |
| ***A63B 21/062*** | (2006.01) |
| *A63B 21/008* | (2006.01) |
| *A63B 21/015* | (2006.01) |
| *A63B 21/02* | (2006.01) |
| *A63B 21/05* | (2006.01) |

(52) U.S. Cl.

CPC ..... *A63B 21/015* (2013.01); *A63B 21/023* (2013.01); *A63B 21/05* (2013.01); *A63B 21/154* (2013.01); *A63B 21/4049* (2015.10); *A63B 2208/0219* (2013.01); *A63B 2208/0228* (2013.01); *A63B 2210/50* (2013.01); *A63B 2225/09* (2013.01); *A63B 2225/093* (2013.01)

(56) References Cited

U.S. PATENT DOCUMENTS 3,101,944 A * 8/1963 Cencig ..... A63B 21/012 482/114
3,394,934 A * 7/1968 Elia ..... A63B 21/068 482/72
4,101,124 A * 7/1978 Mahnke ..... A63B 21/068 482/145
4,383,684 A * 5/1983 Schliep ..... A63B 21/068 482/96
4,930,769 A * 6/1990 Nenoff ..... A63B 21/068 482/142
4,989,860 A * 2/1991 Iams ..... A63B 23/0355 482/132
5,169,363 A * 12/1992 Campanaro ..... A63B 21/068 482/96
5,518,483 A * 5/1996 Oswald ..... A63B 21/012 482/114
5,906,564 A * 5/1999 Jacobsen ..... A63B 21/068 482/96
5,921,901 A * 7/1999 Palacios ..... A63B 23/0211 482/131
5,938,571 A * 8/1999 Stevens ..... A63B 21/068 482/96
5,941,803 A * 8/1999 Chamberlain ..... A63B 21/4045 482/51
5,967,955 A * 10/1999 Westfall ..... A63B 21/068 482/142
D419,625 S * 1/2000 Barnett ..... A63B 23/0355 D21/674
D425,585 S * 5/2000 Wu ..... A63B 22/205 D21/673
6,071,217 A 6/2000 Barnett
D439,291 S * 3/2001 Barnett ..... A63B 21/4047 D21/662
6,196,954 B1 * 3/2001 Chen ..... A63B 22/203 482/131
6,368,254 B1 * 4/2002 Wall ..... A63B 21/055 482/122
6,607,472 B2 * 8/2003 Toole ..... A63B 21/0552 482/121
6,767,314 B2 * 7/2004 Thompson ..... A63B 21/068 482/135
7,179,212 B2 * 2/2007 Hsiung ..... A63B 23/02 482/140
D584,367 S * 1/2009 Augustine ..... A63B 21/00065 D21/662
7,662,076 B1 * 2/2010 Ho ..... A63B 21/068 482/130
7,780,585 B1 * 8/2010 Rivas ..... A63B 21/0552 482/140
7,878,957 B1 * 2/2011 Chen ..... A63B 22/0046 482/131
7,938,763 B2 * 5/2011 Campanaro ..... A63B 21/068 482/140
8,033,971 B2 * 10/2011 Campanaro ..... A63B 21/068 482/142
8,075,457 B2 * 12/2011 Campanaro ..... A63B 21/068 482/96
8,118,718 B2 * 2/2012 Brodess ..... A63B 21/0428 482/123
D660,383 S * 5/2012 Watterson ..... A63B 21/068 D21/689
8,241,186 B2 * 8/2012 Brodess ..... A63B 21/0428 482/44
D671,177 S * 11/2012 Sip ..... D21/689
D671,178 S * 11/2012 Sip ..... D21/689
8,641,585 B2 * 2/2014 LaGree ..... A63B 21/023 482/92
8,702,575 B2 * 4/2014 McVay ..... A63B 21/068 482/142
8,944,980 B2 * 2/2015 Ho ..... A63B 21/068 482/132
8,944,981 B2 * 2/2015 Ho ..... A63B 23/0227 482/132
9,028,374 B1 * 5/2015 Brady ..... A63B 22/0076 482/72
9,770,623 B2 * 9/2017 Ellis ..... A63B 21/068 482/140
2002/0132706 A1 * 9/2002 Sleamaker ..... A63B 21/068 482/51
2002/0183172 A1 * 12/2002 Chen ..... A63B 21/068 482/95
2004/0053752 A1 * 3/2004 Yang ..... A63B 21/0552 482/70
2004/0166998 A1 * 8/2004 Campanaro ..... A63B 21/068 482/95
2004/0248713 A1 * 12/2004 Campanaro ..... A63B 21/068 482/123
2005/0159278 A1 * 7/2005 McVay ..... A63B 21/068 482/142
2007/0111866 A1 * 5/2007 McVay ..... A63B 21/068 482/95
2007/0149370 A1 * 6/2007 Brown ..... A63B 21/068 482/140
2007/0179027 A1 * 8/2007 Van Straaten ..... A63B 22/14 482/71
2008/0070766 A1 * 3/2008 Brown ..... A63B 21/068 482/140
2008/0161173 A1 * 7/2008 Campanaro ..... A63B 21/068 482/133
2009/0098988 A1 * 4/2009 Kennedy ..... A63B 22/203 482/140
2009/0176631 A1 * 7/2009 Blessing ..... A63B 22/0061 482/71
2009/0181834 A1 * 7/2009 Campanaro ..... A63B 21/068 482/96
2010/0248911 A1 * 9/2010 Myers ..... A63B 21/068 482/96
2011/0009249 A1 * 1/2011 Campanaro ..... A63B 21/068 482/131
2012/0053028 A1 * 3/2012 Campanaro ..... A63B 21/00072 482/131
2012/0115694 A1 * 5/2012 Chen ..... A63B 22/205 482/142
2012/0115695 A1 * 5/2012 Watterson ..... A63B 22/14 482/142
2012/0283079 A1 * 11/2012 Solow ..... A63B 21/0552 482/142
2012/0295771 A1 * 11/2012 LaGree ..... A63B 21/023 482/94
2013/0244844 A1 * 9/2013 Solow ..... A63B 21/023 482/142
2014/0162857 A1 * 6/2014 Shade ..... A63B 23/1236 482/141
2014/0194260 A1 * 7/2014 Campanaro ..... A63B 21/068 482/131
2015/0057127 A1 * 2/2015 Lagree ..... A63B 24/0087 482/4

(56) References Cited

U.S. PATENT DOCUMENTS

| | | | | |
|---|---|---|---|---|
| 2015/0343250 | A1* | 12/2015 | Lagree | A63B 21/068 482/142 |
| 2015/0367173 | A1* | 12/2015 | Ellis | A63B 22/0076 482/72 |
| 2016/0317858 | A1* | 11/2016 | Lagree | A63B 21/068 482/96 |
| 2017/0304678 | A1* | 10/2017 | Shade | A63B 21/068 482/135 |
| 2018/0133532 | A1* | 5/2018 | Lagree | A63B 21/068 482/131 |

* cited by examiner

EXERCISE DEVICE

FIELD OF THE INVENTION

This invention relates to an exercise device and, more particularly, to an exercise device utilizing resistance and gravity to work the muscles of the user, particularly those of the upper and lower body.

BACKGROUND OF THE INVENTION

Generally, exercise devices provide a framework for individuals to strengthen and stretch various muscle groups. Devices that assist users in targeting their abdominal muscle groups have been especially popular over the past few decades. One difficulty associated with marketing an exercise device—especially one targeted at abdominal muscles—is that a device that provides only one or two possible exercise movements can quickly become unused by the purchaser. One reason for this is that the user develops muscle memory: after a few weeks of training with a single exercise movement, the user's muscles targeted by that particular exercise become stronger and are better able to perform that movement. As a result, the user feels that the exercise movement is no longer strenuous enough. The user is likely, at that point, to discontinue use of the exercise device.

Many exercise devices, therefore, lack the features and functionality to continually challenge users' fitness. For example, to the extent that most devices employ resistance forces to increase the difficulty of an exercise movement, that resistance cannot be readily varied to adapt to the strength of the user. Also, most devices facilitate only a single exercise movement, which, as described above, quickly becomes boring. Finally, many known devices are relatively bulky, heavy and difficult to store in small storage areas.

Accordingly, a need has developed for a low-cost, portable exercise device that provides easily variable resistance for one or more exercises. What is also needed is an exercise device that facilitates a number of beneficial exercise movements that target multiple muscle groups and/or a muscle group in a variety of useful ways. Further, there is a need for such exercise devices to be easy to manufacture, assemble, use, and store in a small space, as well as that they be safe to use.

SUMMARY OF THE INVENTION

It is an object of the present invention, therefore, to provide an exercise device that provides easily variable resistance for one or more exercises.

It is another object of the present invention to provide an exercise device that facilitates a number of exercise movements.

It is still another object of the present invention to provide an exercise device that is easy to manufacture, assemble, use, and store in a small space, as well as that they be safe to use.

According to a first embodiment of the present invention, an exercise device is provided that comprises: a track comprising a first end and a second end; a track carriage disposed on and movable along the track; a resistance system selectively engageable with the track carriage to provide variable resistance to movement of the track carriage along the track; and a platform adapted to support a user of the device, rotatably secured to the carriage such that the platform rotates relative to the track carriage about an axis that is perpendicular to the track.

In some embodiments, the resistance system comprises at least one elastic member; and the elastic member provides resistance against movement of the track carriage away from the first end of the track. In some embodiments, the device further comprises at least one first handle adjacent the second end of the track. In some embodiments, the device further comprises a foot pad adjacent the first end of the track, wherein the foot pad includes at least one surface oriented perpendicular to the track.

In some embodiments, the device further comprises a vertical support comprising a plurality of support positions each adapted to support the second end of the track for varying the height of the second end of the track relative to the first end of the track; and a hinge pivotably connected to the second end of the track, the hinge comprising: a pin for engaging at least one of the plurality of support positions; and a lock for engaging the track to inhibit movement of the hinge relative to the track.

In some embodiments, the track carriage further comprises at least one second handle that extends in a direction approximately perpendicular to the track. In some embodiments, the device further comprises a support bar comprising a first end and a second end, wherein the first end is pivotably connected to a bottom portion of the vertical support and a second end is pivotably connected to an underside of the track. In some embodiments, the platform rotates 360° about the axis.

According to a second embodiment of the present invention, an exercise device is provided that comprises: a track comprising a first end and a second end; a track carriage disposed on and movable along the track; a resistance system selectively engageable with the track carriage to provide variable resistance to movement of the track carriage along the track; a platform adapted to support a user of the device secured to the track carriage; and at least one handle adjacent the second end of the track.

In some embodiments, the resistance system comprises at least one elastic member; and the elastic member provides resistance against movement of the track carriage away from the first end of the track. In some embodiments, the device further comprises two handles adjacent the second end of the track; and at least one arm support pad adjacent to the handles; where each handle extends in a direction approximately perpendicular to the track.

In some embodiments, the device further comprises: a vertical support comprising a plurality of support positions each adapted to support the second end of the track for varying the height of the second end of the track relative to the first end of the track; a hinge pivotably connected to the second end of the track, the hinge comprising: a pin for engaging at least one of the plurality of support positions; and a lock for engaging the track to inhibit movement of the hinge relative to the track.

In some embodiments, the platform is rotatably secured to the carriage such that the platform rotates relative to the carriage about an axis that is perpendicular to the track; and the track carriage further comprises at least one second handle that extends in a direction approximately perpendicular to the track.

According to a third embodiment of the present invention, an exercise device is provided that comprises: a track comprising a first end and a second end; a track carriage disposed on and movable along the track; a resistance system selectively engageable with the track carriage to provide variable resistance to movement of the track carriage along the track; a platform adapted to support a user of the device secured to the track carriage; and a foot pad adjacent the first end of the track, wherein the foot pad includes at least one surface oriented perpendicular to the track.

In some embodiments, the foot pad is removably secured adjacent the first end of the track using at least one post. In some embodiments, the resistance system comprises at least one elastic member; and the elastic member provides resistance against movement of the track carriage away from the first end of the track.

In some embodiments, the device further comprises: a strut connected to the first end of the track by at least one strut hinge; and a knee pad removably connected to the strut. In some embodiments, the strut is connected to the first end of the track by two strut hinges. In some embodiments, the track carriage further comprises at least one handle.

In some embodiments, the device further comprises: a vertical support comprising a plurality of support positions each adapted to support the second end of the track for varying the height of the second end of the track relative to the first end of the track; a hinge pivotably connected to the second end of the track, the hinge comprising: a pin for engaging at least one of the plurality of support positions; and a lock for engaging the track to inhibit movement of the hinge relative to the track.

According to a fourth embodiment of the present invention, a kit to facilitate exercising is provided, which comprises: an exercise device, comprising: a track comprising a first end and a second end; at least one first handle adjacent to the second end of the track; a track carriage disposed on and movable along the track; a resistance system selectively engageable with the track carriage to provide variable resistance to movement of the track carriage along the track; wherein the resistance system comprises at least one elastic member and wherein the elastic member provides resistance against movement of the track carriage away from the first end of the track; a platform adapted to support a user of the device, rotatably secured to the track carriage such that the platform rotates relative to the track carriage about an axis that is perpendicular to the track; at least one second handle secured to the track carriage that extends in a direction approximately perpendicular to the track; a vertical support comprising a plurality of support positions each adapted to support the second end of the track for varying the height of the second end of the track relative to the first end of the track; and a strut connected to the first end of the track by at least one strut hinge. The kit also comprises a foot pad, removably securable to the exercise device adjacent to the first end of the track; and a knee pad, removably securable to the strut.

Embodiments of the present invention include devices that permit a user to perform multiple exercises. Examples of features that help achieve this are the track carrier that includes both a platform adapted to support a user as well as at least one handle, another handle adjacent the second end of the track, the resistance system that provides variable resistance, and the ability to vary the elevation of the second end of the track. Some embodiments of the present invention permit users to vary both the amount of elastic band resistance and the amount of gravity resistance in order to vary the overall difficulty of an exercise.

Additional features and functions of embodiments of the present invention will now be described in further detail with reference to the following drawings.

DETAILED DESCRIPTION OF THE INVENTION

Figure 1:
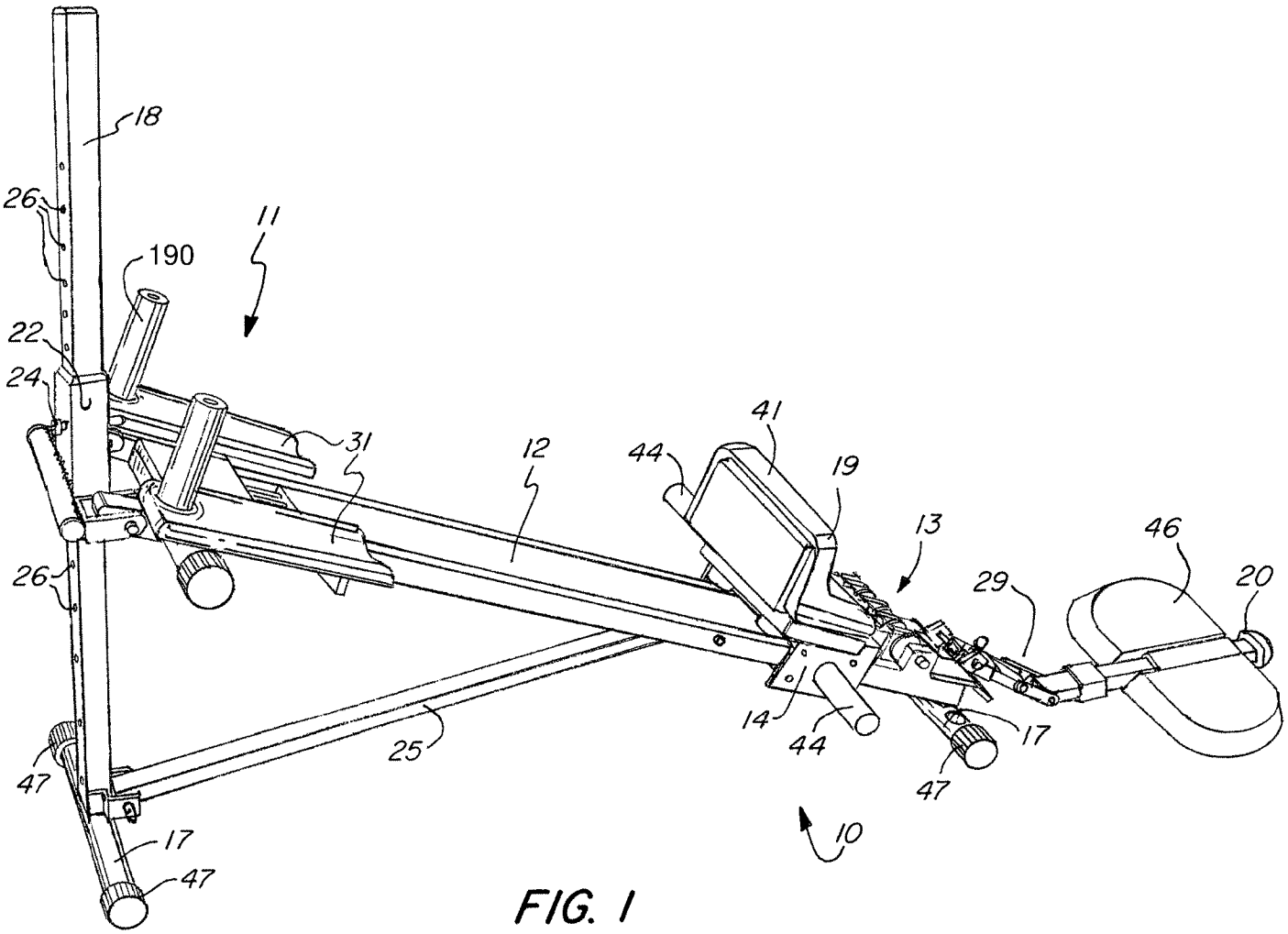
FIG. 1 is a perspective view of a first embodiment of an exercise device according to the present invention.

Embodiments of the present invention will now be described with reference to the figures. FIG. 1 shows a perspective view of a first embodiment of an exercise device 10. The exercise device 10 includes a track 12 and a track carriage 14. Preferably, stabilizing supports 17 are mounted to the device 10 in order to restrict the lateral movement of the device 10. The track includes a first end 11 and a second end 13.

A resistance system 30 is connected to the track 12 and track carriage 14, and provides unidirectional, selectively variable resistance to the track carriage. In most embodiments, the resistance system includes at least one elongated elastic member, one end of which may be releasably attached to the track carriage to increase the resistance force of the resistance system. Further, at least one pulley near one end of the track is provided for directing the elongated elastic members of the resistance system toward the track carriage.

Figure 2:
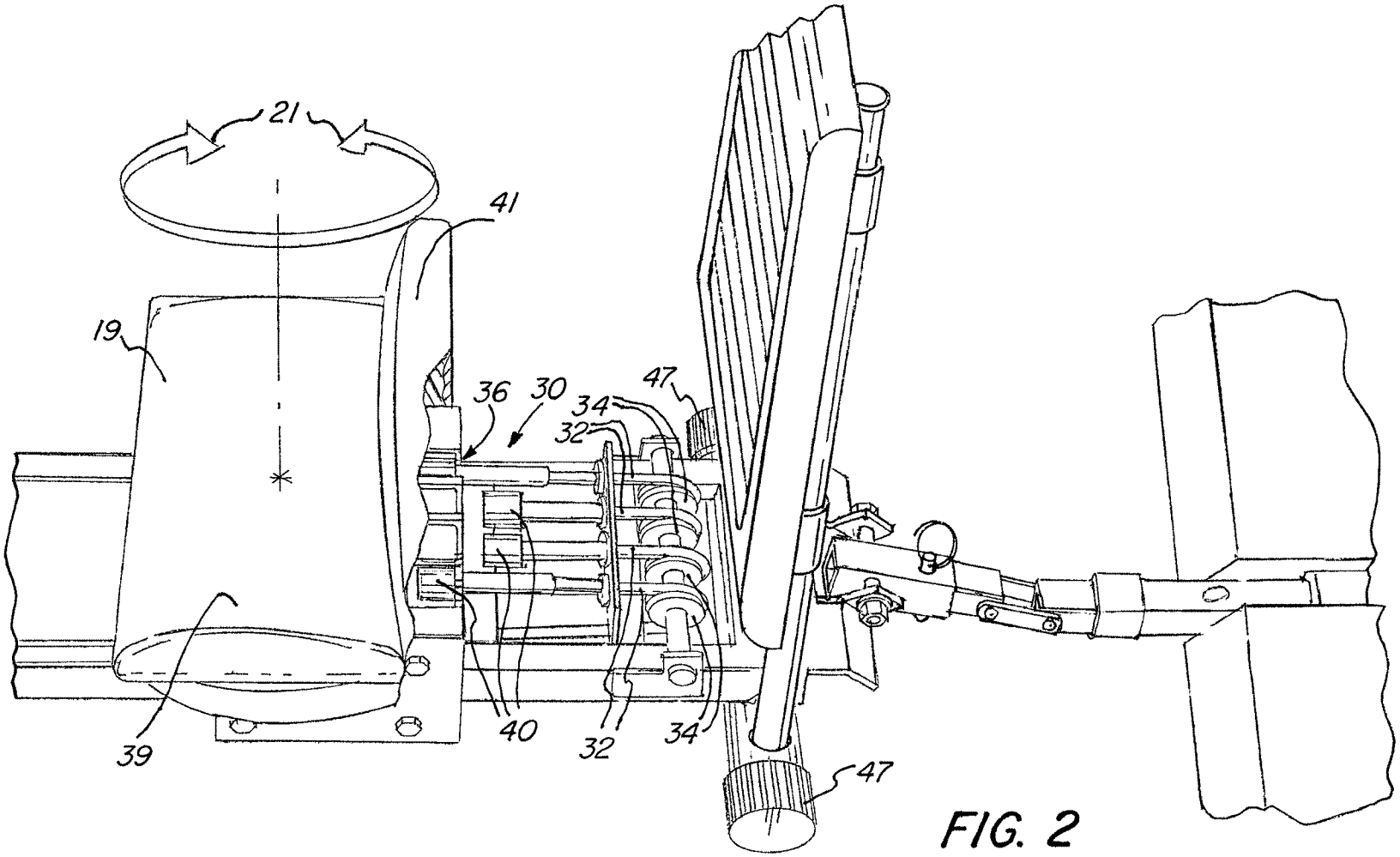
FIG. 2 is a perspective view of a portion of the embodiment of FIG. 1.
Figure 4:
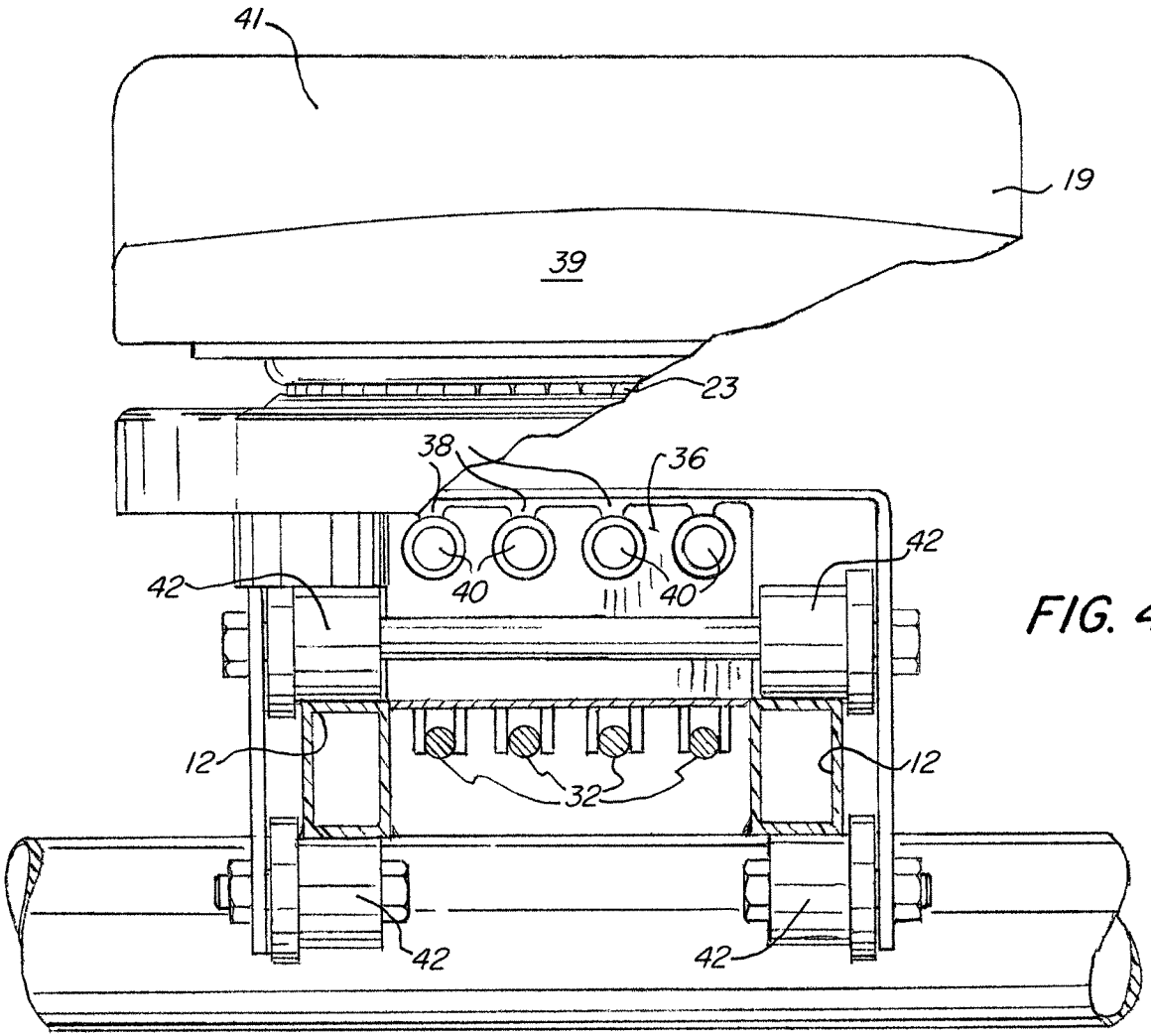
FIG. 4 is a partial cross section view taken along line 4-4 shown in FIG. 3.
Figure 5:
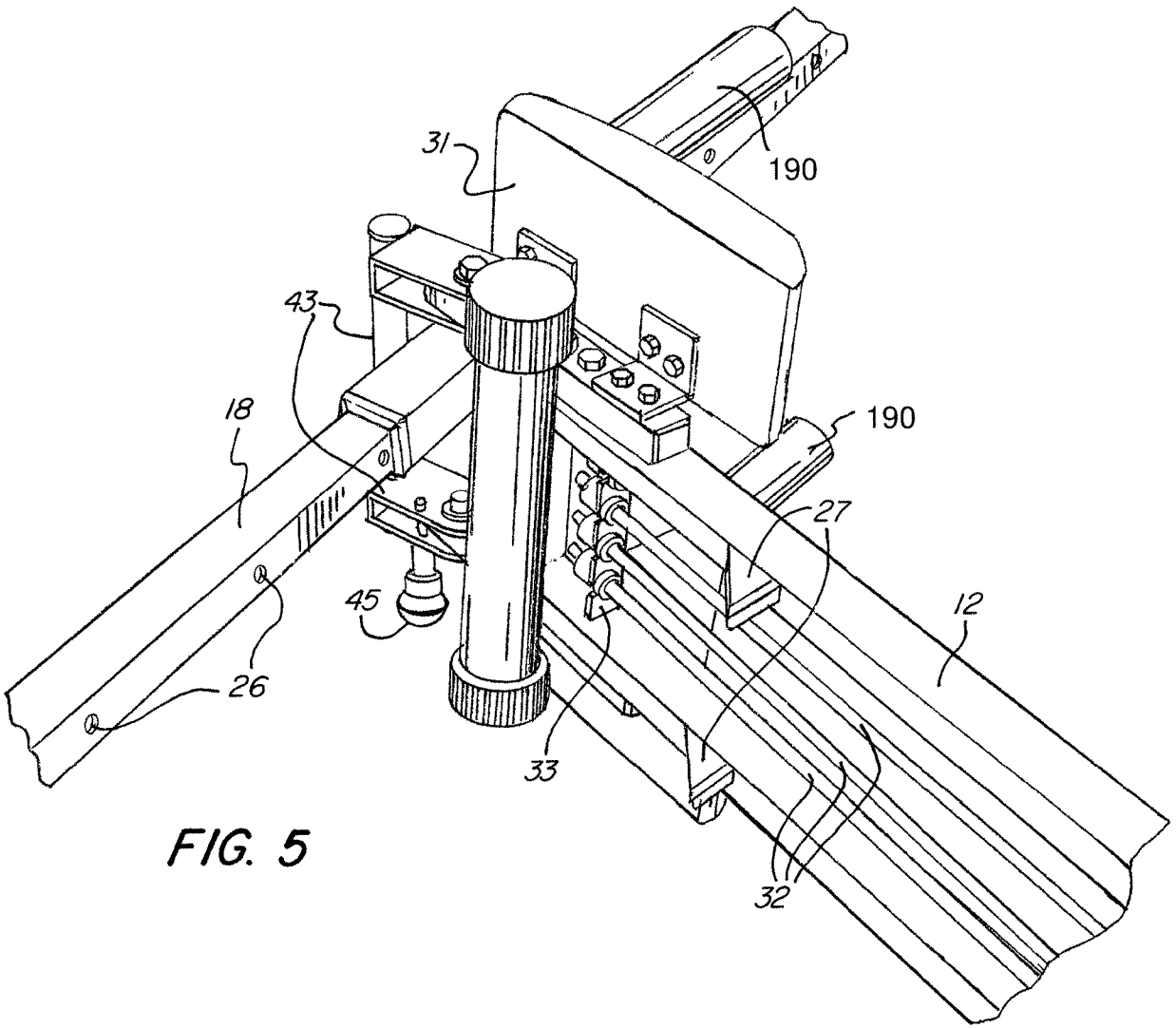
FIG. 5 is a perspective view of a portion of the underside of the embodiment of FIG. 1.
Figure 6:
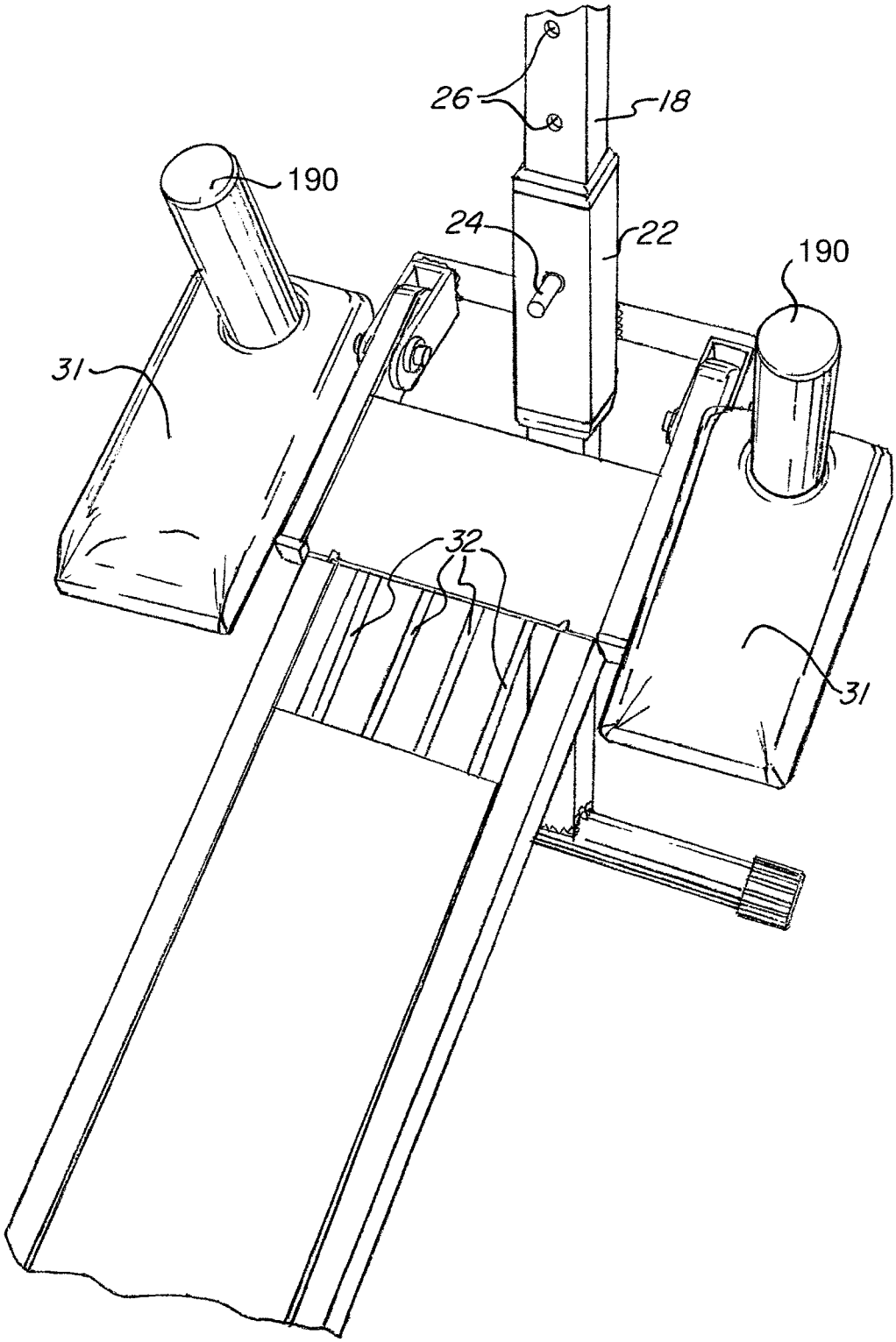
FIG. 6 is a perspective view of a portion of the topside of the embodiment of FIG. 1.

FIGS. 2, 4, and 5 show additional details regarding the resistance system used in the embodiment of FIG. 1. The resistance system 30 includes elastic members 32 of a material that resist tensile loading (preferably of a bungee cord-like material), and are individually carried by pulleys 34, which are mounted to the track 12. Each elastic member 32 is bolted, via a retaining plate 33, to the track 12 on the underside of the second end 13 of the track 12, as shown in FIG. 5. The elastic members are then each threaded through one of the pulleys 34 adjacent to the first end 11 of the track and attached to a support plate 36 of the track carriage 14. As can be seen in FIG. 4, the support plate 36 has slots 38 for the receiving elastic members 32. A stop 40 is placed upon each elastic member 32 to secure the elastic member when it is placed within a respective slot 38, or to alternatively prevent the elastic member from passing through the pulley once an elastic member is released from a slot.

FIGS. 2, 4, and 5 illustrate that there are four elastic members 32. In some embodiments, the elastic members 32 are of varying strength and may be selectively attached to the support plate 36 by the user to increase the amount of force needed to move the track carriage 14 in a direction away from the pulleys 34. Because the elastic members 32 are elastic, a user may stretch the elastic member either to place or remove the elastic member from one of the slots 38. Further, the number of elastic members may be increased, or replaced with members of greater or lesser resistance depending on the user's election.

In other embodiments, the resistance system takes other forms that provide unidirectional, selectively variable resistance. For example, in lieu of elastic members, friction rollers, hydraulic devices, compression springs, etc. are employed in other embodiments to provide resistance against the movement of the track carriage in one direction and facilitate a return movement of the track carriage in the other direction. Such other devices allow the user to regulate the amount of resistance applied to the track carriage.

The resistance system provides variable tension to allow users of differing strength capabilities to use the exercise device. For example, the resistance system compensates for users having weak abdominal muscle groups by exerting a force opposite to the direction of the forward movement of the track carriage for some of the exercises as described below. The intensity of the exercise can be varied by changing the resistance of the resistance system. For certain exercises, then, greater resistance decreases the difficulty of the exercise. For other exercises, as described below, the resistance system provides additional difficulty.

Figure 3:
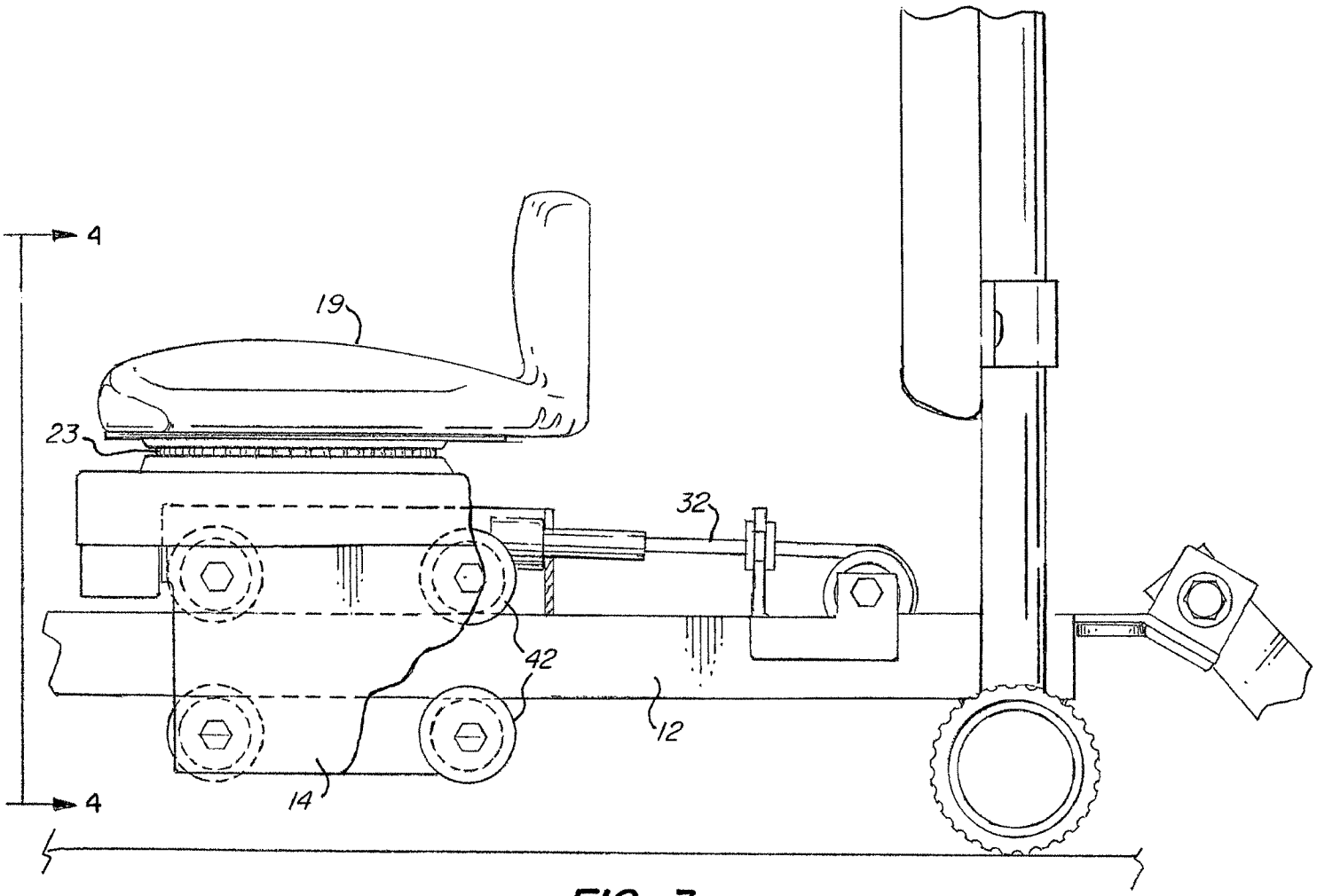
FIG. 3 is a side view of a portion of the embodiment of FIG. 1.

FIGS. 2, 3, and 4 show additional details related to the track carriage 14. The carriage 14 includes at least one bearing engaging the track 12. As shown in FIG. 4, the bearing members 42 are bolted to the track carriage 14 and engage the track 12. In the embodiment shown, the track carriage 14 includes eight bearing members 42, with four being positioned on the top side of the track 12 and four being positioned on the underside of the track 12. FIG. 4 shows only four such bearing members 42, which are positioned to roll against the track 12, and provide a smooth sliding motion to the track carriage 14. The bearing members 42 are preferably made of nylon, or of a similarly durable material having a low coefficient of friction. Additionally, FIG. 5 shows stops 27 which arrest the travel of the carriage 14 on the track 12.

FIGS. 2, 3, and 4 also show that the carriage 14 includes a platform 19. In the embodiment shown, the platform 19 is rotatably secured to the carriage 14, such that the platform rotates about an axis that is substantially perpendicular to the track 12. The arrow 21 shows the rotation direction of the platform 19. To enable this rotating movement, the platform 19 is supported on the carriage by a rotary bearing 23. In the embodiment shown, the rotary bearing 23 enables the platform to rotate in a continuous 360° arc. In other words, the platform is free to turn continuously. In other embodiments, the platform is not supported by a rotary bearing and is, therefore, stationary. In still other embodiments, the rotational travel of the platform is limited to, for example, 90° in either direction. Such limitations on the rotating of the platform may be desirable for safety reasons.

The platform 19 is adapted to support a user of the device 10. In the embodiment shown in the figures, the platform 19 includes padding 39 on its lower surface for acting as a seat or for supporting the knees of a user, as described below. Further, the platform 19, in some embodiments, includes a knee stop 41, which provides a surface for the user's knees or hips to bear against during certain exercises (described below).

FIGS. 1, 5, 6, and 7 show features of the device 10 that enable the user to elevate the second end 13 relative to the first end 11. The track 12 is pivotably connected at its second end to a sleeve 22 by a bracket 43 that is adjustably carried by a vertical support 18. The sleeve 22 and bracket 43 effectively function as a hinge to pivotably connect the track 12 to the vertical support 18. The sleeve 22 can be maneuvered along the vertical support 18 and fixed into a preselected location through the use of a support lock pin 24. The support lock pin 24 is engageable in each of the support positions 26, which allow for the track 12 to be elevated from a generally horizontal position to an angled one relative to the surface on which the device is placed. By elevating the second end 13 of the track, the user can adjust the amount of exertion required to perform the exercise movements described herein. Additionally, by elevating the track member, the user may exercise different muscles groups. A support bar 25 is pivotably attached at the bottom of the vertical support 18 and is pivotably attached to the underside of the track 12. The support bar 25 stabilizes the device 10 when the second end 13 is elevated and helps prevent an unexpected crash lowering of the track. For storage purposes, the support bar 25 is detachable at one or both ends to permit folding of the device 10.

FIG. 5 shows an additional safety feature intended to reduce the likelihood that the second end 13 will unexpectedly lower. The bracket 43 that links the sleeve 22 to the track 12 does so in a manner that permits the sleeve 22 and track 12 to pivot relative to one another. This pivoting allows the track to be elevated at its second end as the sleeve 22 slides over the vertical support 18. The bracket 43 includes a pivot lock pin 45 that functions as an anti-pivot lock. When the pivot lock pin 45 is engaged, the bracket 43 is locked against pivoting relative to the track 12. In this way, should the support lock pin 24 fail unexpectedly, the sleeve 22 will not fall the entire length of the vertical support 18. With the pivot lock pin 45 engaged, the sleeve 22 will bind on the support 18 and the track will descend only a few inches at most.

Figure 8:
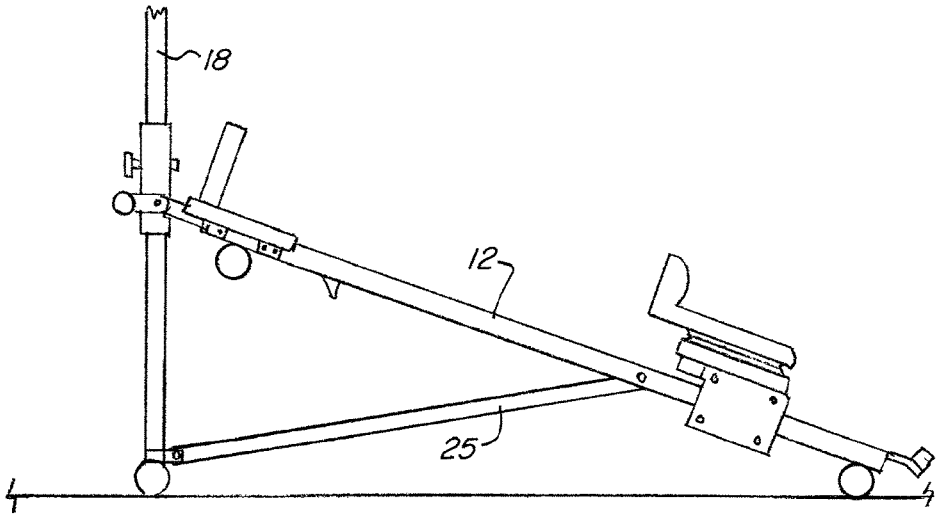
FIG. 8 is a side view of the embodiment of FIG. 1.
Figure 9:
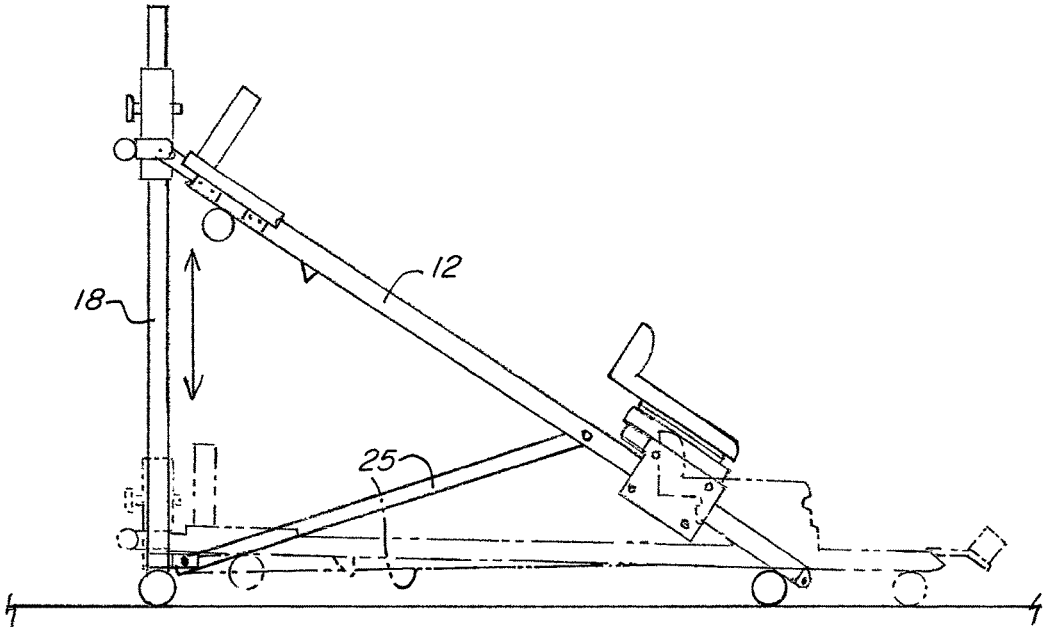
FIG. 9 is a side view of the embodiment of FIG. 1 in an alternative position.
Figure 10:
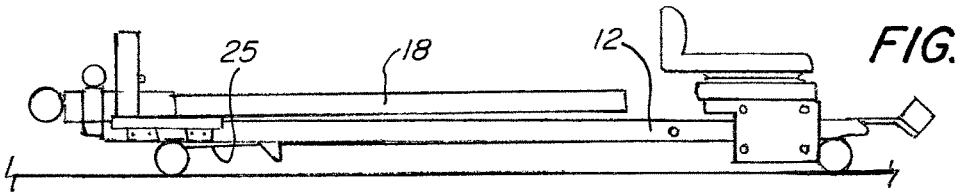
FIG. 10 is a side view of the embodiment of FIG. 1 in a storage position.

FIGS. 8, 9, and 10 show three exemplary vertical positions of the device 10. In FIG. 8, the second end 13 of the track 12 has been raised to a middle position on the vertical support 18. FIG. 9 shows the highest position into which the second end 13 of the track 12 can be placed. The bottom position, in which the device is essentially horizontal, is shown in broken lines in FIG. 9 for comparison purposes. Finally, FIG. 10 shows the device in its storage configuration, in which the vertical support has been folded so as to be parallel with the track 12. To assist with storage and movement of the device around a user's home or office, embodiments of the invention include wheels 47 on the stabilizing supports 17. The wheels 47 are, in most embodiments, simple in design and inexpensive. For example, the wheels 47 in the embodiment shown are rotating end caps, which are placed on the ends of the generally cylindrical supports 17.

As shown in FIG. 1, handles 44 are mounted on either side of the track carriage 14 and provide a surface for the user to engage and maneuver the track carriage. Also shown in FIG. 1 is pad 46, which provides a surface to support the user's knees and is suitably mounted to the strut 20. The strut 20 is attached by one or more hinges 29 to the first end 11 of the track 12. In the embodiment shown in FIG. 1, the strut is attached by two hinges 29. This arrangement permits the strut to remain on the flat on the ground regardless of changes to the elevation of the second end 13. So, no matter how high the second end is raised using the vertical support 18, the strut will lie in the correct position on the ground. The pad 46 is adjustable and can be positioned along the strut depending on the user's preference and size.

Figure 11:
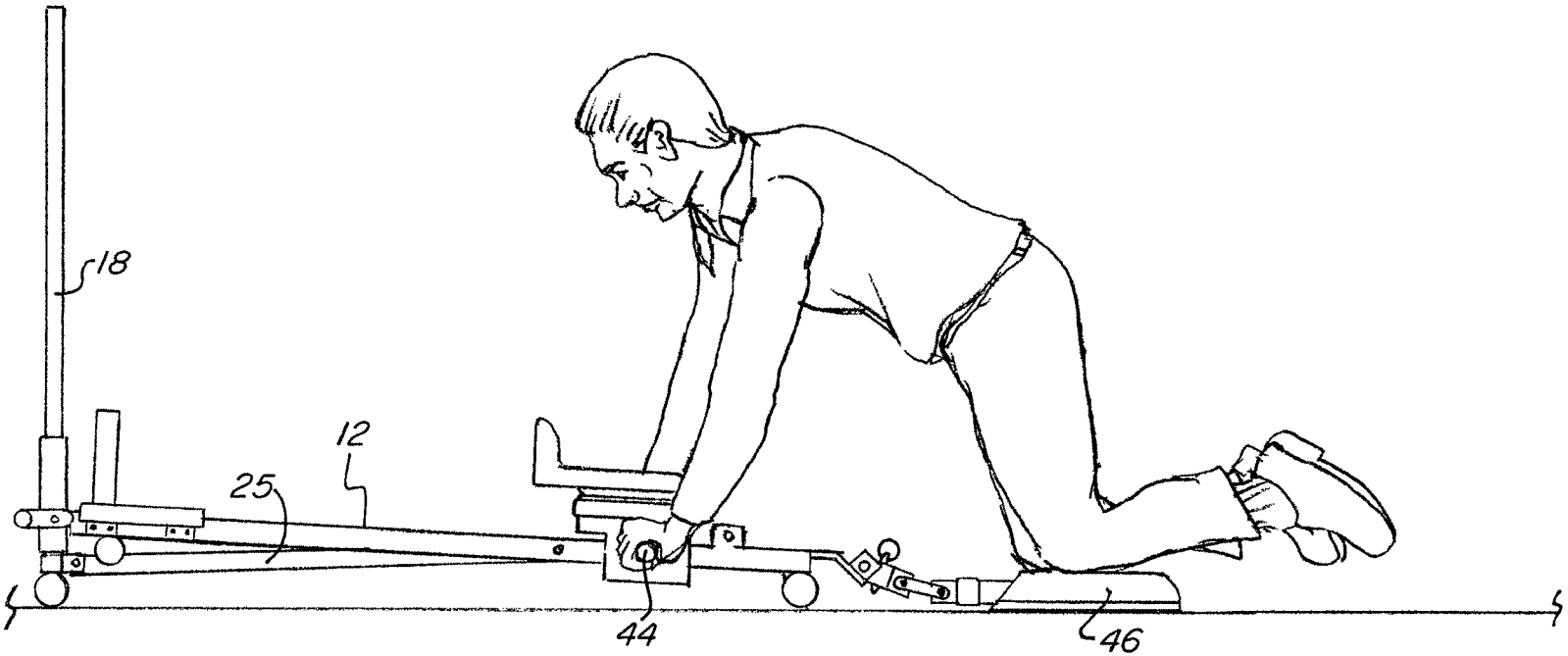
FIG. 11 is a perspective view showing a user performing a first exercise on the embodiment of FIG. 1.

FIG. 11 shows the exercise device 10 utilized for a first movement. The user places his or her knees on the pad 46, grasps the handles 44 of the track carriage, and then extends his or her upper body while holding onto the handles of the track carriage. As the user extends forwardly, the track carriage 14 moves toward the second end 13 of the track 12, encountering increasing resistance from the resistance system. Once the user has reached a desired extension along the track, he returns to the starting position with the aid of the resistance system, which helps the user pull the track carriage back to its original position. By the repetition of moving back and forth from the kneeling-prone position, the user receives a vigorous, upper body and abdominal workout.

By increasing the amount of resistance applied to the carriage 14, the first exercise shown in FIG. 11 actually becomes easier to perform. This can be accomplished by either attaching more elongated elastic members 32 to the carriage 14 or by increasing the height of the second end 13, or by doing both. Conversely, by decreasing the resistance applied to the carriage 14, the exercise shown in FIG. 10 becomes more difficult, as the muscles of the user's abdomen are required to do more work to resist gravity working on the torso of the user.

Figure 7:
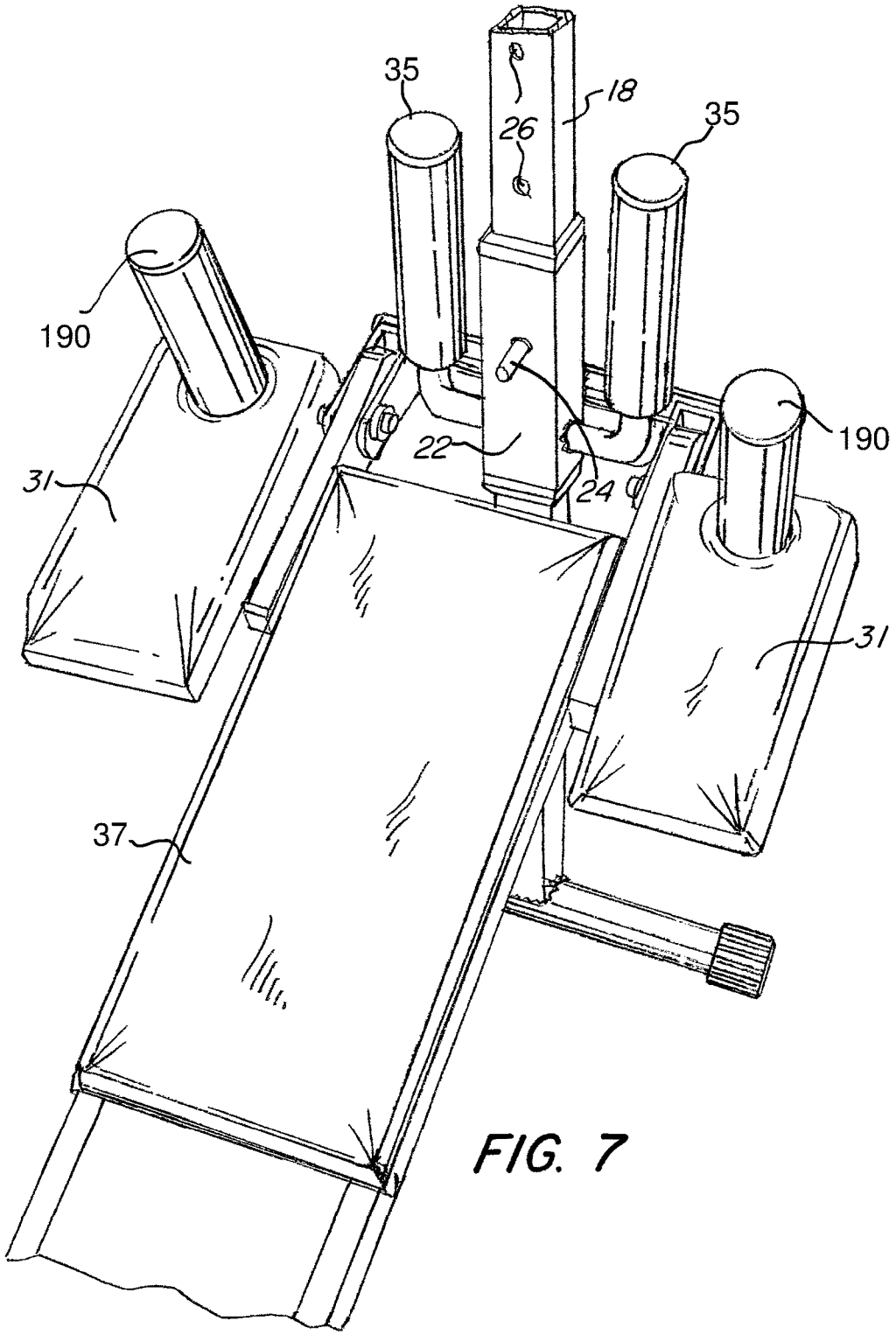
FIG. 7 is a perspective view of a portion of the topside of an alternative embodiment of the present invention.

Adjacent to the first end 11 of the track 12, are one or more handles 190 that are adapted to be gripped by a user of the device 10. The handles 190 are shown in FIGS. 1, 5, 6, and 7 and, in this embodiment, are oriented so that they protrude in a direction that is approximately perpendicular to the track 12 and, in particular, generally vertically relative to the track. In other embodiments, the handles 190 protrude in a general horizontal direction with respect to the track. Different handle orientations provide slightly different muscle engagement during certain exercises. In the embodiment shown, there are two handles 190 and two pads 31 associated with the handles. The pads 31 are adapted to support the forearms of a user who is gripping the handles. FIG. 7 shows an alternative embodiment of the second end 13 of the device 10, in which alternative handles 35 are included along with an alternate pad 37. The provision of the alternate handles and pad enables a user to vary his or her grip and, thereby, vary the muscles impacted by an exercise movement.

Figure 12:
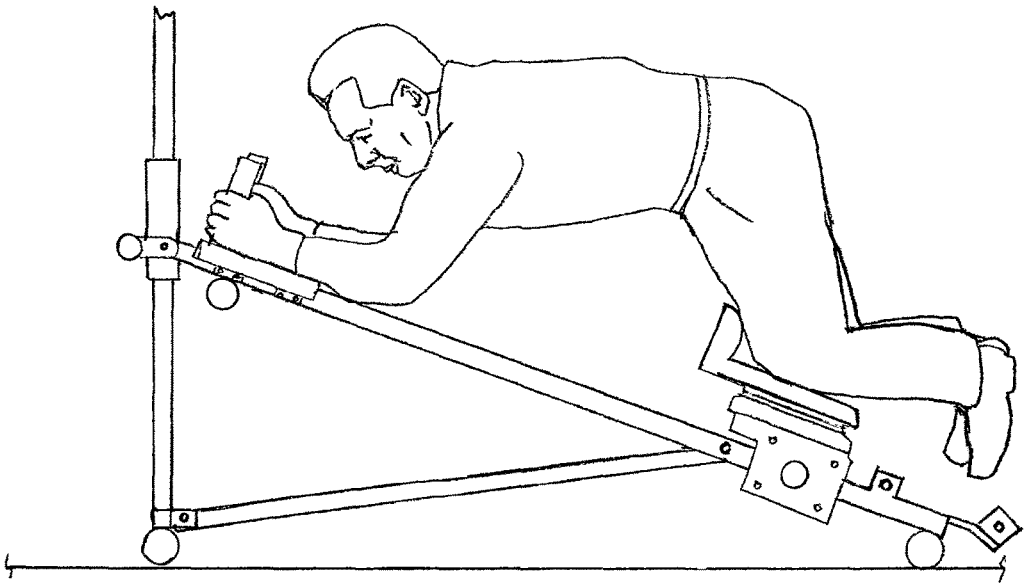
FIG. 12 is a side view showing a user performing a second exercise on the embodiment of FIG. 1.
Figure 13:
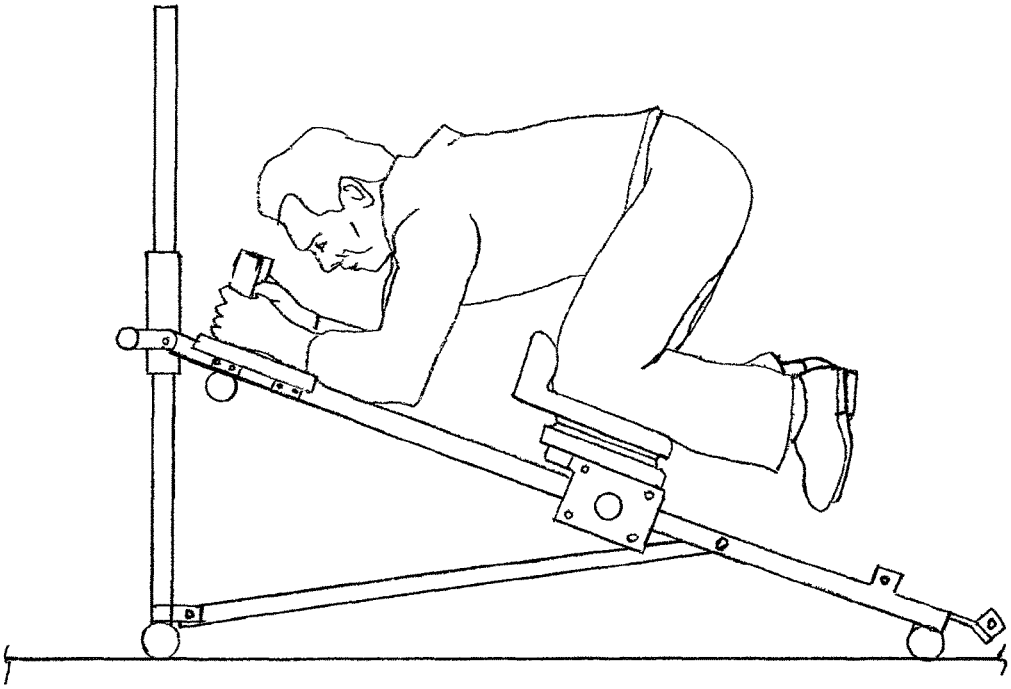
FIG. 13 is a side view showing the user performing the exercise of FIG. 12.

FIGS. 12 and 13 illustrate a second exercise movement for which the device is adapted. The second exercise is akin to a "hanging knee raise" (sometimes referred to as a "captain's chair exercise") in that the movement in large part mimics that exercise. As shown in FIG. 12, the user first kneels on the platform 19. Then, the user rests his or her forearms on the pads 31 (or 37) and grips the handles 190 (or 35) with his or her hands. The user then pulls his or her knees toward his or her elbows and chest, such that the carriage 14 moves along the track 12 toward the second end 13 of the track 12. FIG. 13 shows the user with his knees pulled toward this elbows and chest.

Contrary to the first exercise described above with reference to FIG. 11, increasing the resistance applied to the carriage 14 will increase the difficulty of the exercise illustrated in FIGS. 12 and 13. This is because the user must pull against the force of the resistance system and/or the force of gravity due to elevation of the second end 13. The least difficult configuration of the device 10 for performing the second exercise is with the second end 13 of the track in its lowest position and without any of the elongated elastic members 32 attached to the carriage 14. Conversely, the second exercise can be made more difficult by elevating the second end 13 and by attaching the elastic members to the carriage.

Figure 14:
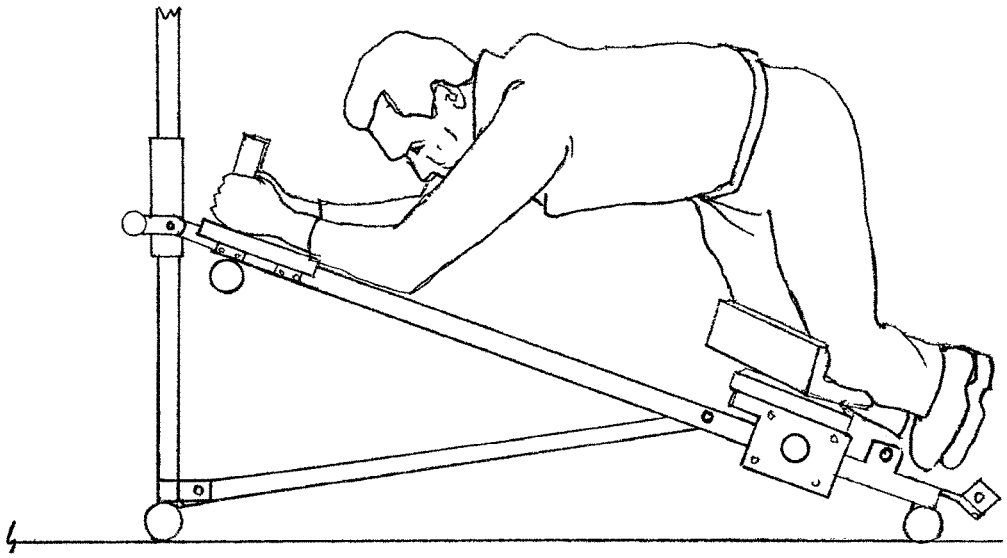
FIG. 14 is a side view showing a user performing an alternative of the second exercise on the embodiment of FIG. 1.
Figure 15:
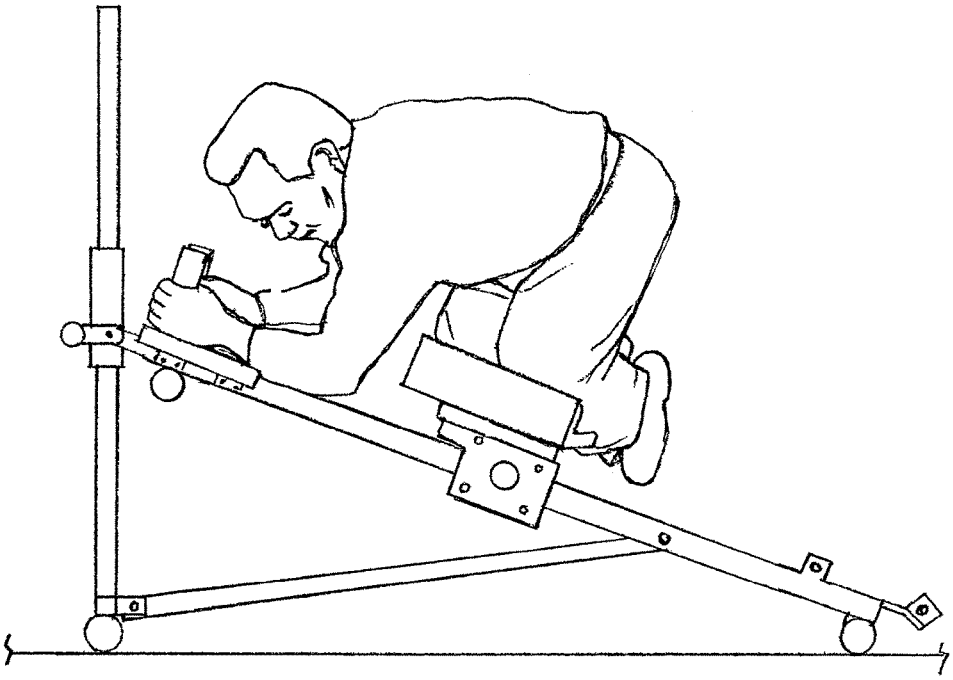
FIG. 15 is a side view showing the user performing the exercise of FIG. 14.

A modification to the second exercise is shown in FIGS. 14 and 15. This is a modified knee raise exercise that targets the oblique abdominal muscles of the user. Instead of the user pulling his or her knees in a straight direction up the track to his or her chest, the user bends his torso to bring either his left knee to his left elbow or his right knee to his right elbow. FIG. 14 shows the starting position for this oblique exercise, in which the user is preparing to pull his right knee toward his right elbow. FIG. 15 shows the user after pulling his right knee to his right elbow. This exercise will target the user's oblique abdominal muscles on the right side of his body. This exercise is facilitated by the feature of the device that the platform is able to rotate about an axis that is substantially perpendicular to the track. This rotating enables the user to twist his body to target the obliques.

In some embodiments of the present invention, a detachable platform may be affixed to the first end of the track in order to allow a user to exercise his or her leg muscles. As shown in FIG. 2, a foot platform or pad 48 is designed to fit onto the first end 11 of the track 12. In the embodiment shown, the foot pad 48 is secured to the device by placing the two posts supporting the pad into corresponding holes formed in the stabilizing support 17.

Figure 16:
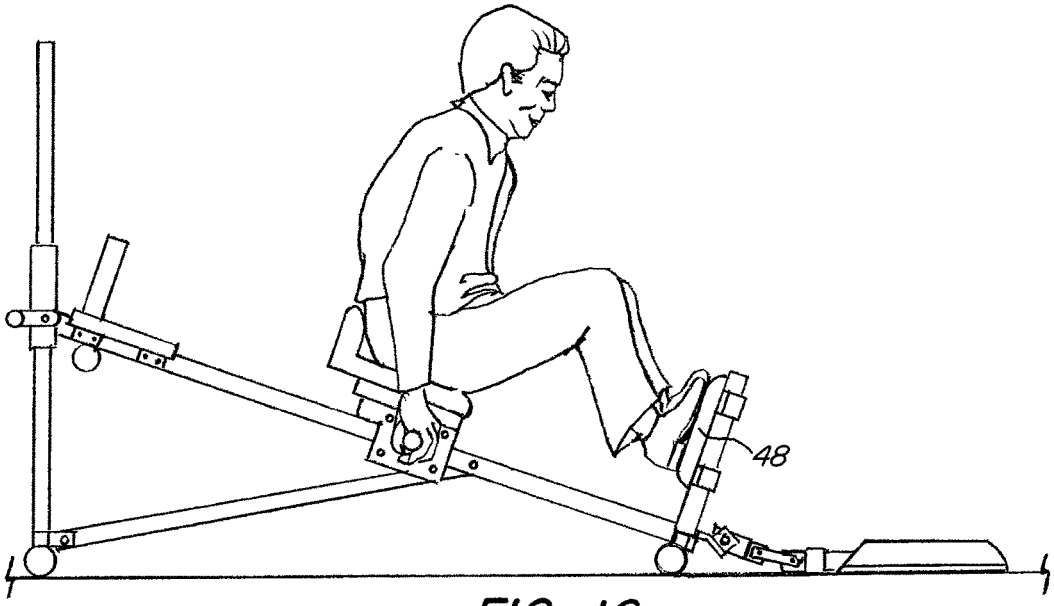
FIG. 16 is a side view of a user performing a third exercise on the embodiment of FIG. 1.
Figure 17:
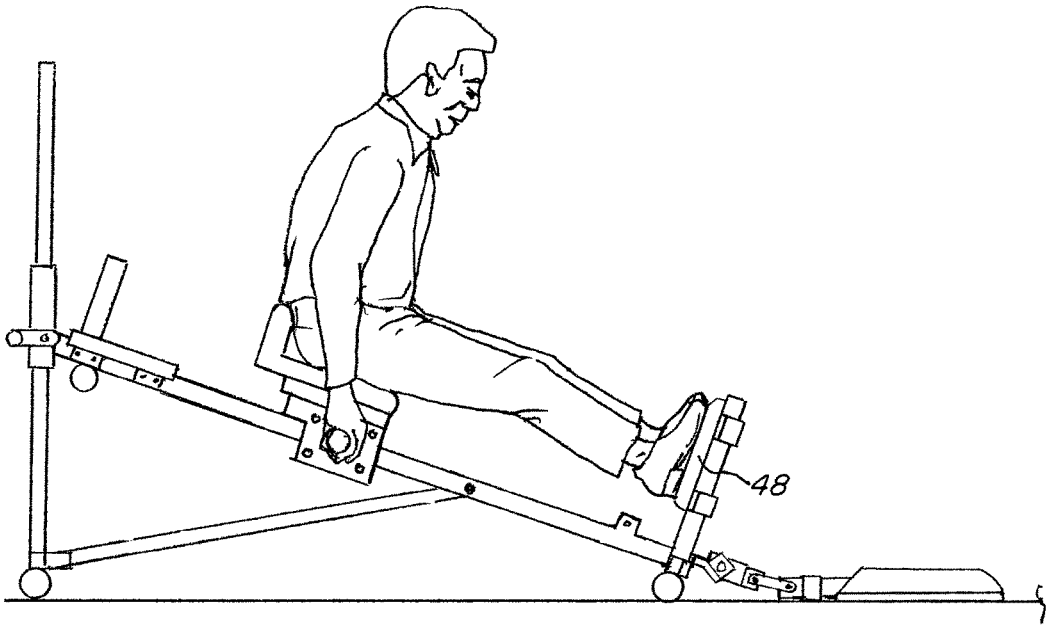
FIG. 17 is a side view of the user performing the exercise of FIG. 16.

FIGS. 16 and 17 illustrate a third exercise movement for which the device 10 adapted using the foot pad 48. To perform this exercise, the user sits on the platform 19, preferably such that the knee stop 41 is against the back of the user's hips, as shown in FIG. 16. The user then places one or both of his or her feet on the pad 48 and presses with his or her legs until they are extended, as shown in FIG. 17. This movement is beneficial to the muscles of the upper leg, including the quadriceps, hamstrings, and glute muscles.

For the third exercise movement, the resistance system functions to increase the difficulty of the movement, as in the second exercise described above. By increasing the resistance acting on the carriage 14, either by attaching elastic members or by increasing the elevation of the second end 13, the difficulty of performing the movement also increases. This permits a user to continue to strengthen his or her muscles even after months of use of the device.

Figure 18:
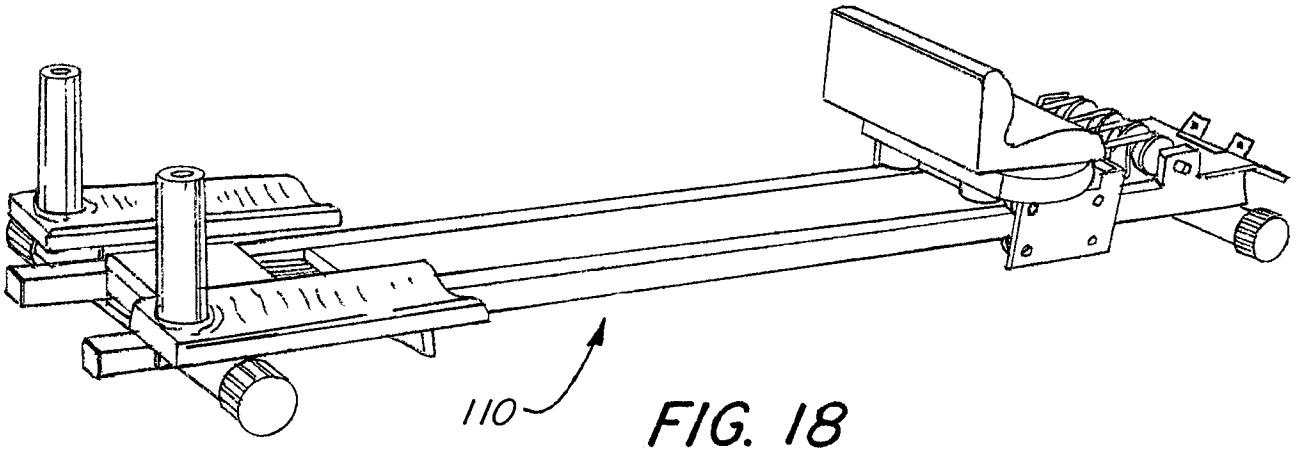
FIG. 18 shows a perspective view of a second embodiment of the present invention.

FIG. 18 shows an embodiment of the present invention that does not include the features necessary to change the height of the second end 13. The device 110 does not include a vertical support or sleeve connected to the track 112 like previously discussed embodiments.

Figure 19:
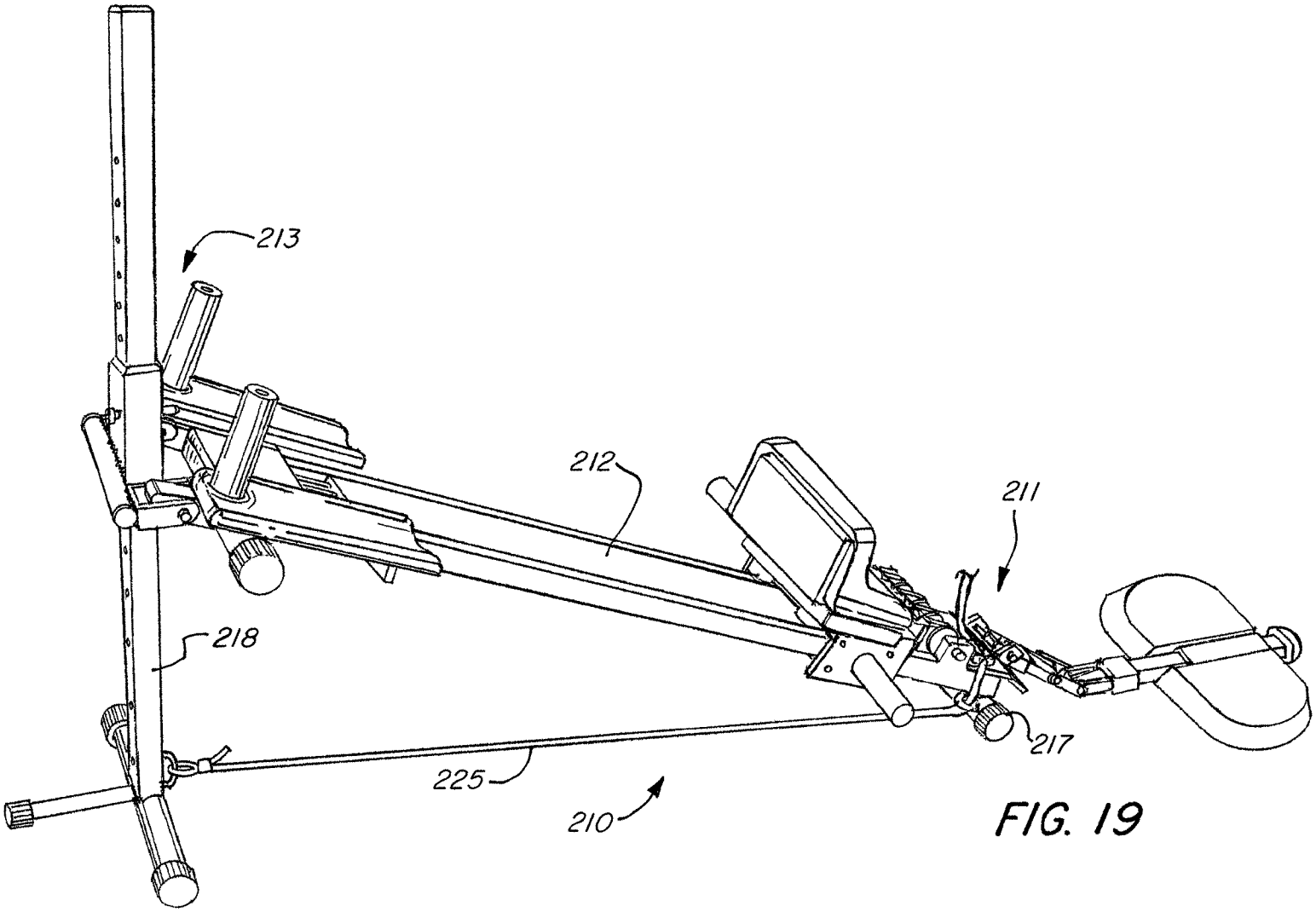
FIG. 19 shows a perspective view of a third embodiment of the present invention.

FIG. 19 shows an additional embodiment of the present invention. The device 210 does not have a support bar 25 like previously discussed embodiments, but, instead, has a cable 225 attached to the base of the vertical support 218 and to the stabilizing support 217 adjacent the first end 211 of the track 212. The cable 225 performs a function similar to that performed by the support 25: it prevents an unexpected collapse of the device 210 when the second end 213 is elevated. Specifically, the cable 225 prevents the base of the vertical support 218 from moving out from underneath the second end 213. Because the distance between the base of the vertical support 218 and the first end 211 of the track 212 varies based on how high the second end 213 is placed, the cable length is adjustable using a cleat on the first end 211.

It will be apparent to those skilled in the art that modifications and variations can be made in the above-described embodiments of the present invention without departing from the scope or spirit of the invention. Thus, it is intended that the present invention cover such modifications and variations provided they come within the scope of the appended claims and their equivalents.

What is claimed is:

1. An exercise device, comprising:

a straight track comprising a first end and a second end;

a track carriage disposed on and movable in a first plane along said track, said track carriage including a handle on each of two sides of said track carriage extending widthwise with respect to said track;

a resistance system selectively engageable with said track carriage to provide variable resistance or assistance to movement of said track carriage along said track;

a platform having a support surface adapted to support a user of the device in seated and kneeling positions, wherein said platform is rotatably secured to said track carriage such that said platform rotates left and right relative to said track carriage, in a second plane substantially parallel to the first plane, about an axis that is perpendicular to said track;

a bracket coupled to the second end of said track; and a vertical support including a plurality of support positions each adapted to support said bracket for selectively varying a height of the bracket and the second end of said track relative to the first end of said track.

2. The device of claim 1, further comprising at least one second handle fixed in position adjacent to the second end of said track.

3. The device of claim 1, further comprising:

a sleeve connected to said bracket and slidable along said vertical support; and a support lock pin that engages through said sleeve and into said vertical support to fix said sleeve at any one of the plurality of support positions.

4. The device of claim 3, wherein said bracket is pivotably connected to the second end of said track.

5. The device of claim 4, wherein said bracket further includes a removable pivot lock pin which, when engaged, prevents pivoting between said bracket and the second end of said track.

6. The device of claim 1, further comprising a foot pad removably attached adjacent to the first end of said track, wherein said foot pad includes a surface oriented perpendicular to said track.

7. The device of claim 1, wherein said resistance system comprises at least one elastic member, wherein the elastic member provides resistance against movement of said track carriage away from the first end of said track and assistance to aid movement of said track carriage towards the first end of said track.

8. The device of claim 1, further comprising a support bar comprising a first end and a second end, wherein the first end is pivotably connected to a bottom portion of said vertical support and a second end is pivotably connected to an underside of said track.

9. The device of claim 1, wherein the platform rotates 360° about the axis.

10. The device of claim 1, further comprising:

a strut connected to the first end of said track by at least one strut hinge; and a knee pad removably connected to said strut.

11. The exercise device of claim 1, wherein the support surface of said platform includes a raised backrest.

12. An exercise device, comprising:

a straight track comprising a first end and a second end;

a track carriage disposed on and movable in a first plane along said track said track carriage including a first handle on each of two sides of said track carriage extending widthwise with respect to said track;

a resistance system selectively engageable with said track carriage to provide variable resistance to movement of said track carriage along said track;

a platform having a support surface adapted to support a user of the device, wherein said platform is rotatably secured to said track carriage such that said platform rotates left and right relative to said track carriage, in a second plane substantially parallel to the first plane, about an axis that is perpendicular to said track;

a bracket on the second end of said track;

a vertical support including a plurality of support positions each adapted to support said bracket for varying a height of the second end of said track relative to the first end of said track;

at least one second handle fixed adjacent to the second end of said track; and at least one arm support pad adjacent to the at least one second handle.

13. An exercise device, comprising:

a track comprising a first end and a second end;

a track carriage disposed on and movable along said track;

a resistance system selectively engageable with said track carriage to provide variable resistance to movement of said track carriage along said track;

a platform adapted to support a user of the device secured to said track carriage;

a foot pad removably securable adjacent the first end of said track, wherein said foot pad includes at least one surface oriented perpendicular to said track wherein said foot pad is removably securable adjacent the first end of said track using at least one post;

a strut connected to the first end of said track by at least one strut hinge; and a knee pad removably connected to said strut;

wherein said track carriage further comprises at least one handle.

14. The device of claim 13, wherein said resistance system comprises at least one elastic member, wherein the elastic member provides resistance against movement of said track carriage away from the first end of said track.

15. The device of claim 13, wherein said strut is connected to the first end of said track by two strut hinges.

16. The device of claim 13, further comprising:

a bracket connected to the second end of said track;

a vertical support comprising a plurality of support positions each adapted to support said bracket for varying a height of the second end of said track relative to the first end of said track;

a support lock pin for engaging at least one of the plurality of support positions; and a pivot lock pin for engaging said bracket to inhibit movement of said bracket relative to said track.

17. The exercise device of claim 13, wherein said platform is rotatably secured to said track carriage such that said platform rotates left and right relative to said track carriage about an axis that is perpendicular to said track.

18. The device of claim 13, further comprising at least one second handle fixed adjacent to the second end of said track.

19. The device of claim 18, further comprising at least one arm support pad adjacent to the at least one second handle.

20. An exercise device, comprising:

a straight track comprising a first end and a second end;

at least one first handle adjacent to the second end of said track;

a track carriage disposed on and movable along said track;

a resistance system selectively engageable with said track carriage to provide variable resistance to movement of said track carriage along said track, wherein said resistance system comprises at least one elastic member and wherein the elastic member provides resistance against movement of said track carriage away from the first end of said track;

a platform adapted to support a user of the device, rotatably secured to said track carriage such that the platform rotates left and right relative to said track carriage about an axis that is perpendicular to said track;

at least one second handle secured to said track carriage that extends in a direction approximately perpendicular to said track;

a vertical support comprising a plurality of support positions each adapted to support the second end of said track for varying a height of the second end of said track relative to the first end of said track;

a strut connected to the first end of said track by at least one strut hinge;

a foot pad, removably securable to the exercise device adjacent to the first end of said track; and a knee pad, removably securable to said strut.

* * * * *